US010882200B1

(12) United States Patent
Shabel

(10) Patent No.: US 10,882,200 B1
(45) Date of Patent: Jan. 5, 2021

(54) RAZOR WITH ROTATABLE BLADE HEAD

(71) Applicant: Mark Shabel, Oceanside, NY (US)

(72) Inventor: Mark Shabel, Oceanside, NY (US)

( * ) Notice: Subject to any disclaimer, the term of this patent is extended or adjusted under 35 U.S.C. 154(b) by 0 days.

(21) Appl. No.: 16/217,813

(22) Filed: Dec. 12, 2018

(51) Int. Cl.
*B26B 21/24* (2006.01)
*B26B 21/16* (2006.01)
*B26B 21/40* (2006.01)
*B26B 21/52* (2006.01)

(52) U.S. Cl.
CPC ..... *B26B 21/24* (2013.01); *B26B 21/165* (2013.01); *B26B 21/4062* (2013.01); *B26B 21/521* (2013.01); *B26B 21/522* (2013.01)

(58) Field of Classification Search
CPC ..... B26B 21/24; B26B 21/521; B26B 21/522; B26B 21/165; B26B 21/4062
See application file for complete search history.

(56) References Cited

U.S. PATENT DOCUMENTS 1,007,847 A * 11/1911 Carlson ..... B26B 21/24 30/40
2,327,284 A * 8/1943 Nyhagen ..... B26B 19/30 30/43.4
2,352,813 A * 7/1944 Testi ..... B26B 21/24 30/40
2,362,666 A * 11/1944 Sarver ..... B26B 19/34 30/41.5
2,565,062 A * 8/1951 Blanchard ..... B26B 21/24 30/32
2,636,263 A * 4/1953 Fennelly ..... B26B 21/24 30/40
3,137,940 A * 6/1964 Curci ..... B26B 21/24 30/40
3,412,464 A * 11/1968 Keck ..... B26B 21/00 30/40
3,430,341 A * 3/1969 Choate ..... B26B 21/24 30/40
3,619,900 A * 11/1971 Matsuura ..... B26B 21/24 30/40
3,722,091 A * 3/1973 Gagnon ..... B26B 21/24 30/40
4,268,958 A * 5/1981 Hilbert ..... B26B 21/4087 30/41.7
D388,540 S * 12/1997 Ramar ..... D28/45
6,055,731 A * 5/2000 Zucker ..... B26B 21/222 30/34.2
6,499,218 B2 12/2002 Rocha
6,581,290 B1 6/2003 Fishel
7,814,661 B2 10/2010 Tomassetti
D632,433 S * 2/2011 Nakasuka ..... D28/48
(Continued)

FOREIGN PATENT DOCUMENTS

GB 191007435 A * 3/1911 ..... B26B 19/16
WO WO-2008085002 A1 * 7/2008 ..... B26B 21/24
WO WO-2011094887 A1 * 8/2011 ..... B26B 21/24

*Primary Examiner* — Jonathan G Riley
(74) *Attorney, Agent, or Firm* — Cramer Patent & Design, PLLC; Aaron R. Cramer

(57) ABSTRACT

A razor has a rotary reel containing a plurality of razor blades. The reel is capable of being manipulated by an advancement knob disposed on a first side of the rotary reel housing. Upon sufficient use, a user may actuate the advancement knob to rotate out of position the used blade while simultaneously rotating into position a new blade.

1 Claim, 6 Drawing Sheets

(56) References Cited

U.S. PATENT DOCUMENTS

| | | | | |
|---|---|---|---|---|
| 7,975,389 | B2 * | 7/2011 | Bozikis | B26B 21/522 30/527 |
| 8,307,553 | B2 | 11/2012 | Follo et al. | |
| 8,615,891 | B2 | 12/2013 | Psimadas et al. | |
| 8,887,401 | B2 * | 11/2014 | Oxford | B26B 21/34 30/41.6 |
| 9,517,570 | B2 * | 12/2016 | Tucker | B26B 21/4031 |
| 9,731,426 | B2 | 8/2017 | Kim et al. | |
| 9,764,487 | B2 | 9/2017 | Robertson et al. | |
| 9,808,945 | B2 | 11/2017 | Robertson | |
| 9,889,572 | B2 | 2/2018 | Bucco | |
| D830,632 | S * | 10/2018 | Hage | D28/46 |
| 10,350,771 | B2 * | 7/2019 | Perlberg | B26B 19/18 |
| 2004/0123467 | A1 * | 7/2004 | Policappelli | B26B 21/24 30/50 |
| 2007/0245564 | A1 * | 10/2007 | Yiu | B26B 21/222 30/40 |
| 2008/0201966 | A1 * | 8/2008 | Psimadas | B26B 21/522 30/526 |
| 2008/0256803 | A1 * | 10/2008 | Tucker | B26B 21/225 30/50 |
| 2009/0013534 | A1 * | 1/2009 | Mallaridas | B26B 21/40 30/41 |
| 2011/0283539 | A1 * | 11/2011 | Bryan | B26B 21/225 30/40.2 |
| 2012/0291295 | A1 * | 11/2012 | Braun | B26B 21/52 30/531 |
| 2014/0230251 | A1 * | 8/2014 | Hage | B26B 21/44 30/41 |
| 2016/0144519 | A1 * | 5/2016 | Hahn | B26B 21/521 30/50 |
| 2016/0263757 | A1 * | 9/2016 | Vandervelde | B26B 21/521 |

* cited by examiner

RAZOR WITH ROTATABLE BLADE HEAD

FIELD OF THE INVENTION

The present invention relates to a razor with rotatable blade head.

BACKGROUND OF THE INVENTION

There are many different methods of shaving available to the consumer today. Various electrical shavers, depilatory creams and lotions, wax treatments and the like are available for men and/or women both. But perhaps the most common method of shaving used is still the disposable razor. It works well, is readily available, and is certainly low cost. However, just like all razors, it does suffer from dull blades at seemingly the most inopportune times. If one is in the shower or tub, he or she must get out and hopefully find a replacement all while dripping water on the floor. If one does not do this, they suffer through a somewhat painful shave with less than optimum results.

Additionally, the old razor is then tossed into the trash where the entire razor, including the relatively massive handle, enters the waste stream, when the only thing wrong with it is the razor blade itself. Accordingly, there exists a need for a means by which disposable razors can be modified to address these shortcomings. The development of the razor with rotatable blade head fulfills this need.

SUMMARY OF THE INVENTION

The inventor has recognized the aforementioned inherent problems and lack in the art and observed that there is a need for an A shaving razor, comprising a handle assembly having an upper flange. The head assembly is connected to the upper flange by a connection means. The head assembly also comprises a contact face with a central horizontal open slot to accommodate one of a plurality of in-use razor blades. The in-use razor blades are connected to a central hub within the blade cartridge and is arranged with a plurality of remaining unused razor blades and a blade cartridge rear of the contact face. The blade cartridge is removable by use of a snap retaining clip which retains the blade cartridge upon attachment. The blade cartridge is also affixed to the contact face with an upper attachment means and a lower attachment means. The blade cartridge is capable of being replaced when all the in-use razor blades have been utilized.

The shaving razor also provides an ergonomic handle, a base grip, a plurality of protrusions which are offered on each of an exterior surface of the upper flange, the ergonomic handle, and the base grip to aid in holding the shaving razor in wet or slippery conditions, an advancement knob which is located on an end of the blade cartridge opposite of the clip. The advancement knob advances one remaining unused razor blade of the remaining unused blades to the position occupied by one in-use razor blade of the in-use razor blades. The advancement knob is provided with a protruding indicia which serves as a gripping point to turn the advancement knob along a rotational advancement path.

The shaving razor also comprises a connection means which is selected from the group consisting of a pivoting hinge, a fixed hinge, or a three hundred sixty degree bearing assembly. The blade cartridge may be purchased as a separate replacement component for the handle assembly, the connection means, and the contact face. The blade cartridge may be removed when the handle assembly when the handle assembly is in a first hand while pressing on the snap retaining clip with fingers from the first hand with a new blade cartridge then being installed. The handle assembly may selected from the group consisting of plastic, metal, wood, or stone. The blade cartridge may be arranged with the remaining unused razor blades at an angular spacing of seventy-two degrees to allow advancing the remaining unused razor blades into a position currently occupied by the in-use razor blade by turning the advancement knob with the protruding indicia as the in-use razor blade becomes dull or damaged.

The in-use razor blades may be connected to a central hub within the blade cartridge and may be arranged with the remaining unused razor blades and advancement of the replacement unused razor blades occur at any time. The upper attachment means may include an upper face track and an upper cartridge track which are attached to the contact face and the blade cartridge respectively.

The lower attachment means may include a lower face track and a lower cartridge track which are attached to the contact face and the blade cartridge respectively. The upper connection means and the lower connection means may involve the upper cartridge track and the lower cartridge track on the blade cartridge to engage the upper face track and the lower face track on the contact face, respectively, to provide a secure fitment.

The upper cartridge track and the upper face track may be generally L-shaped protrusions with a second leg parallel with the first leg to securely engage each other. The lower cartridge track and the lower face track are identically-shaped. The shaving razor may be utilized dry, with water or with a shaving product.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
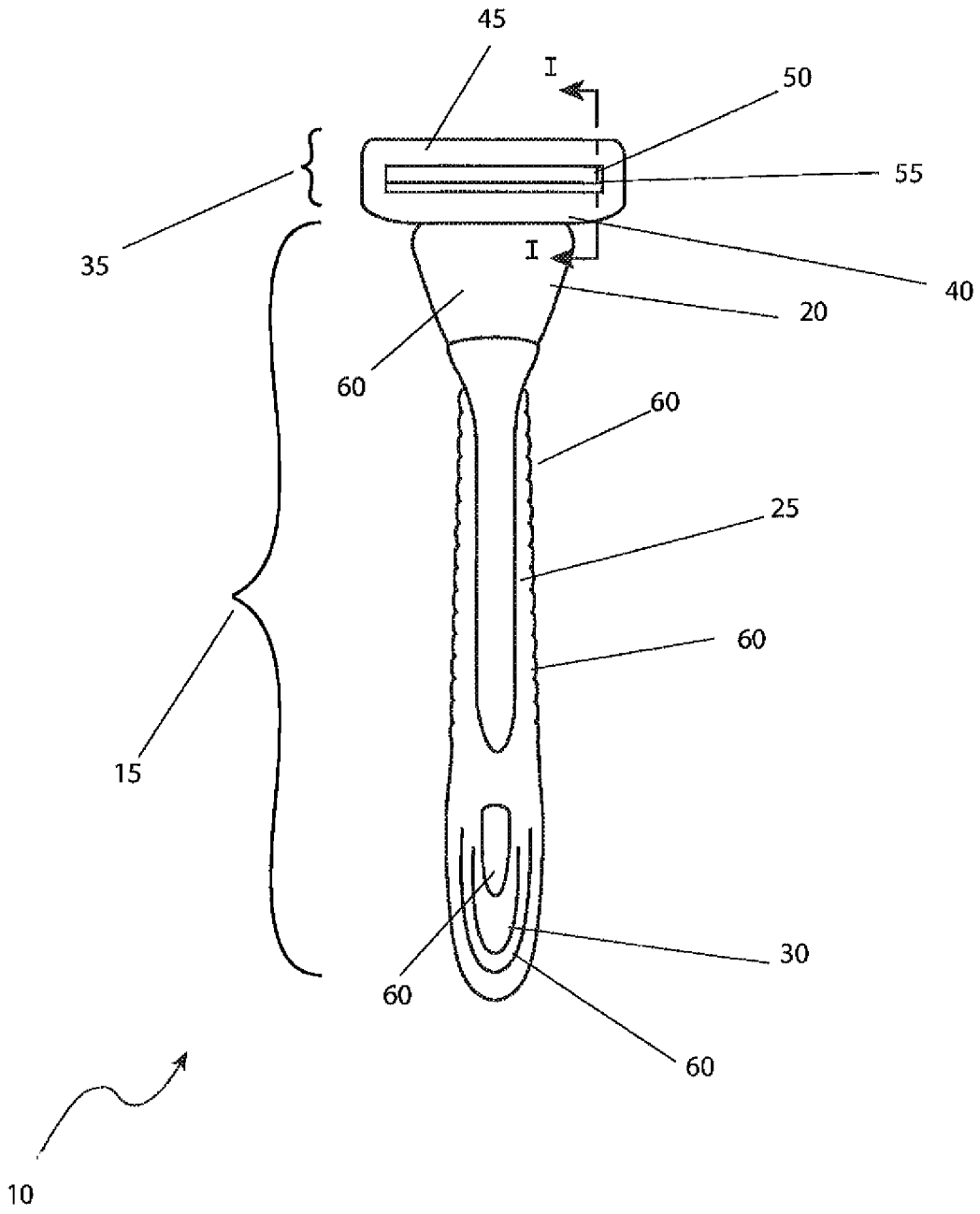
FIG. 1 is a front view of the shaving razor 10 with replaceable and rotatable blade cartridge 65, according to the preferred embodiment of the present invention.

10 shaving razor
15 handle assembly
20 upper flange
25 ergonomic handle

30 base grip
35 head assembly
40 connection means
45 contact face
50 open slot
55 in-use razor blade
60 protrusion
65 blade cartridge
70 clip
75 advancement knob
80 protruding indicia
85 rotational advancement path "r"
90 upper attachment means
95 lower attachment means
100 upper face track
105 upper cartridge track
110 lower face track
115 lower cartridge track
120 central hub
125 unused razor blade
130 removal travel path "t"

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the shaving razor 10 with replaceable and rotatable blade cartridge 65, according to the preferred embodiment of the present invention is disclosed. The shaving razor (herein also described as the "device") 10, provides a handle assembly 15 having an upper flange 20, an ergonomic handle 25, and a base grip 30. It is envisioned that the handle assembly 15 could be manufactured from a wide range of material including plastic for low price versions as well as metal, wood, or even stone for premium versions. The exact material of construction is not intended to be a limiting factor of the present invention.

A head assembly 35 is connected to the upper flange 20 by a connection means 40, such as a pivoting hinge, a fixed hinge, a three hundred sixty degree (360°) bearing assembly or the like. The exact method of attachment of the head assembly 35 is not intended to be a limiting factor of the present invention. The head assembly 35 has a contact face 45 with a central horizontal open slot 50. An in-use razor blade 55 is visible in the open slot 50. The device 10 is utilized during the shaving process as a common razor and may be utilized dry, with water, or with a shaving product depending on the user's needs and/or desires. Various protrusions 60 are offered on the exterior surfaces of the upper flange 20, the ergonomic handle 25, and the base grip 30 to aid in holding the device 10 in wet or slippery conditions.

Figure 2:
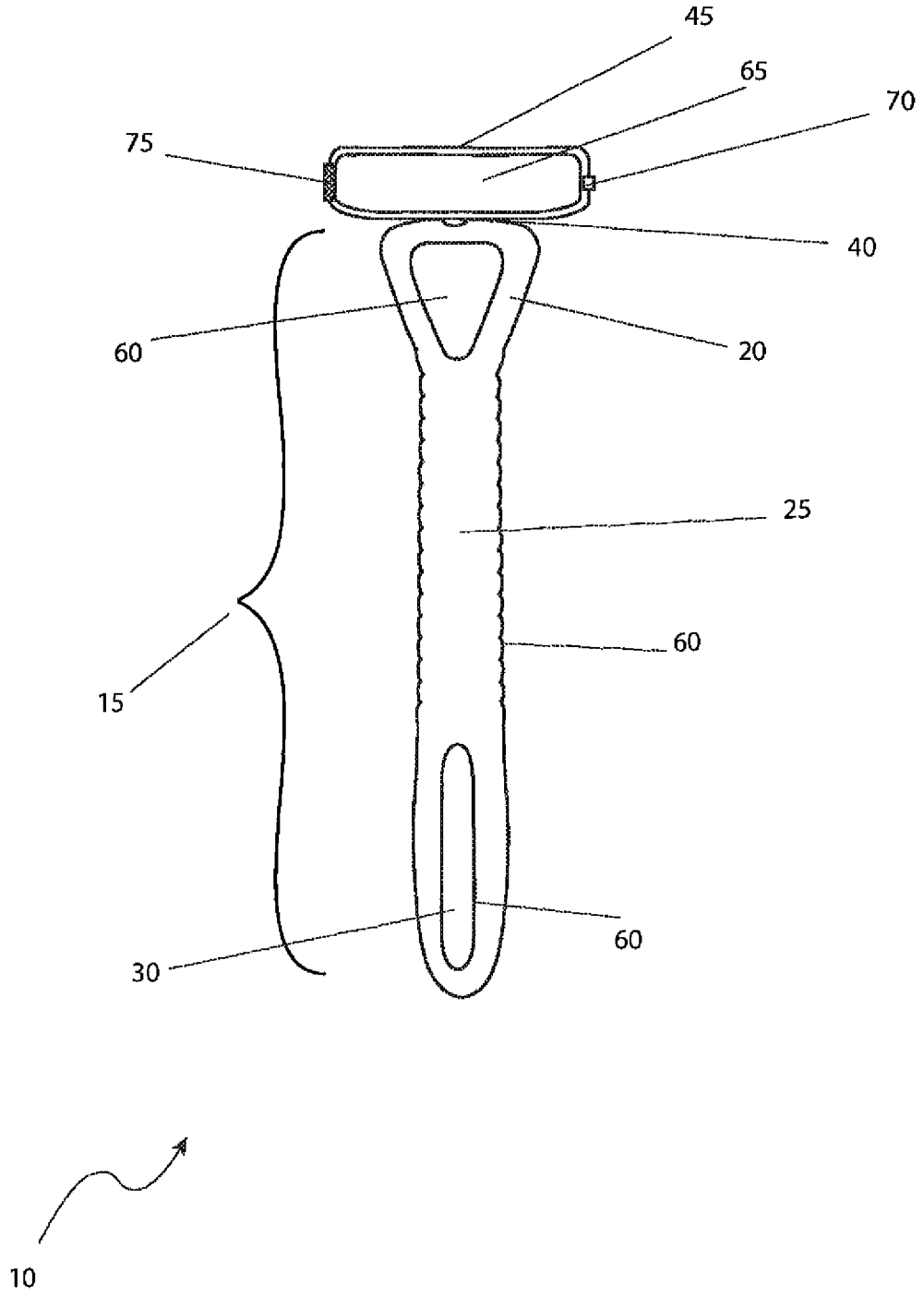
FIG. 2 is a rear view of the shaving razor 10 with replaceable and rotatable blade cartridge 65, according to the preferred embodiment of the present invention.

Referring next to FIG. 2, a rear view of the device 10, according to the preferred embodiment of the present invention is depicted. The upper flange 20, the ergonomic handle 25 and the base grip 30, along with the corresponding protrusions 60 are visible as aforementioned described. The rear of the contact face 45 is also visible along with a blade cartridge 65. The blade cartridge 65 holds a total of five (5) razor blades 55, 125 (not visible due to illustrative limitations) of which the in-use razor blade 55 (as shown in FIG. 1) is one (1) of the five (5). The blade cartridge 65 is removable by use of a snap retaining clip 70 which retains the blade cartridge 65 upon attachment. The removable nature of the blade cartridge 65 will be described in greater detail herein below. An advancement knob 75 is located on the end of the blade cartridge 65 opposite of the clip 70, and is used to advance one (1) of the five (5) blades 15, 125 to the position occupied by the in-use razor blade 55 (as shown in FIG. 1). It is envisioned that the blade cartridge 65 would be purchasable by the final user as a separate replacement component for use with the handle assembly 15, connection means 40, and contact face 45.

Figure 3:
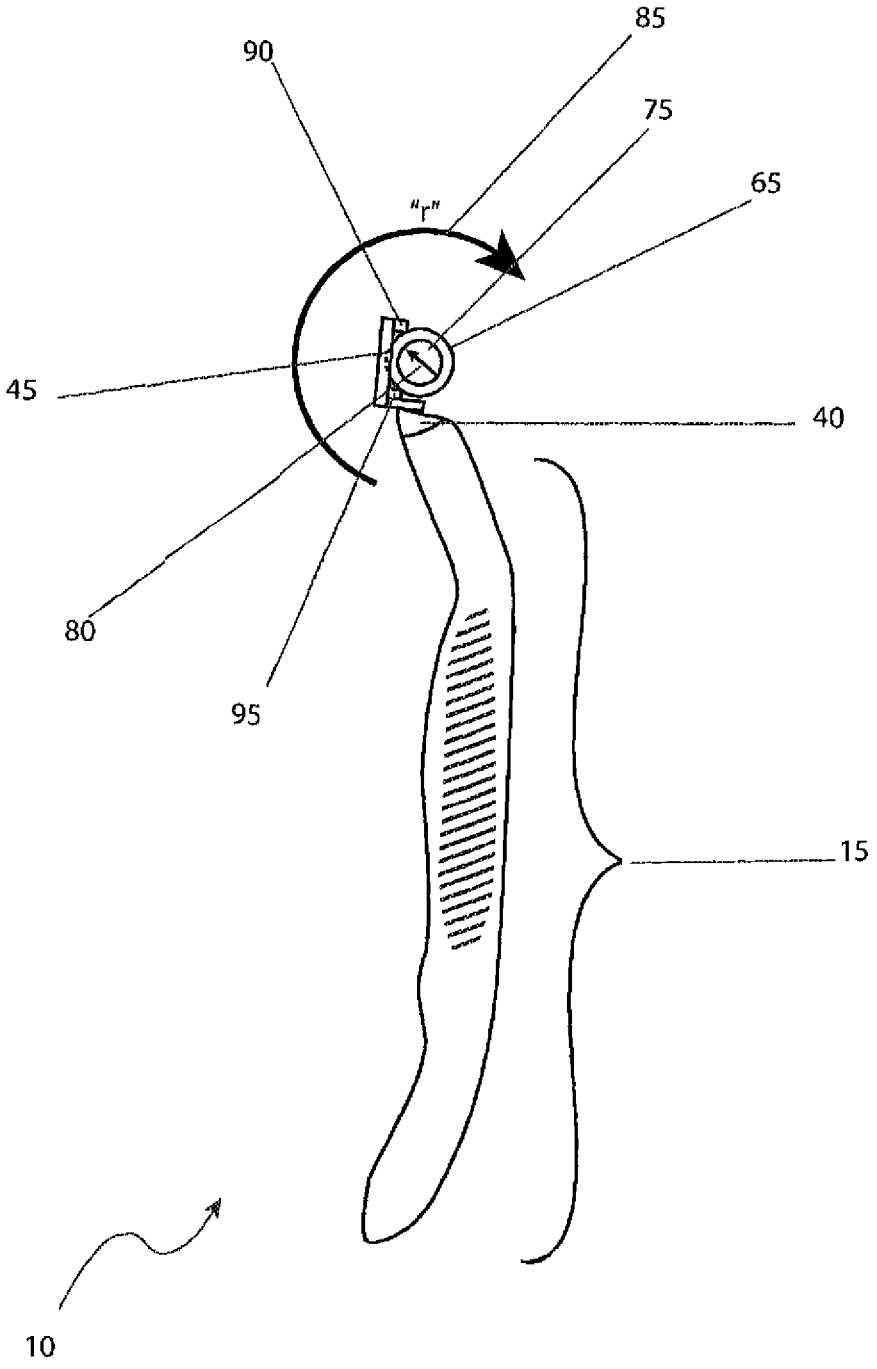
FIG. 3 is a side view of the shaving razor 10 with replaceable and rotatable blade cartridge 65, according to the preferred embodiment of the present invention.

Referring now to FIG. 3, a side view of the device 10, according to the preferred embodiment of the present invention is shown. The handle assembly 15 and the connection means 40 are visible along with the contact face 45. The advancement knob 75 is provided with a protruding indicia 80 which serves as a gripping point for the user's fingertips to turn the advancement knob 75 along a rotational advancement path "r" 85. The blade cartridge 65 is affixed to the contact face 45 with the aid of an upper attachment means 90 and a lower attachment means 95, both of which will be described in greater detail herein below.

Figure 4:
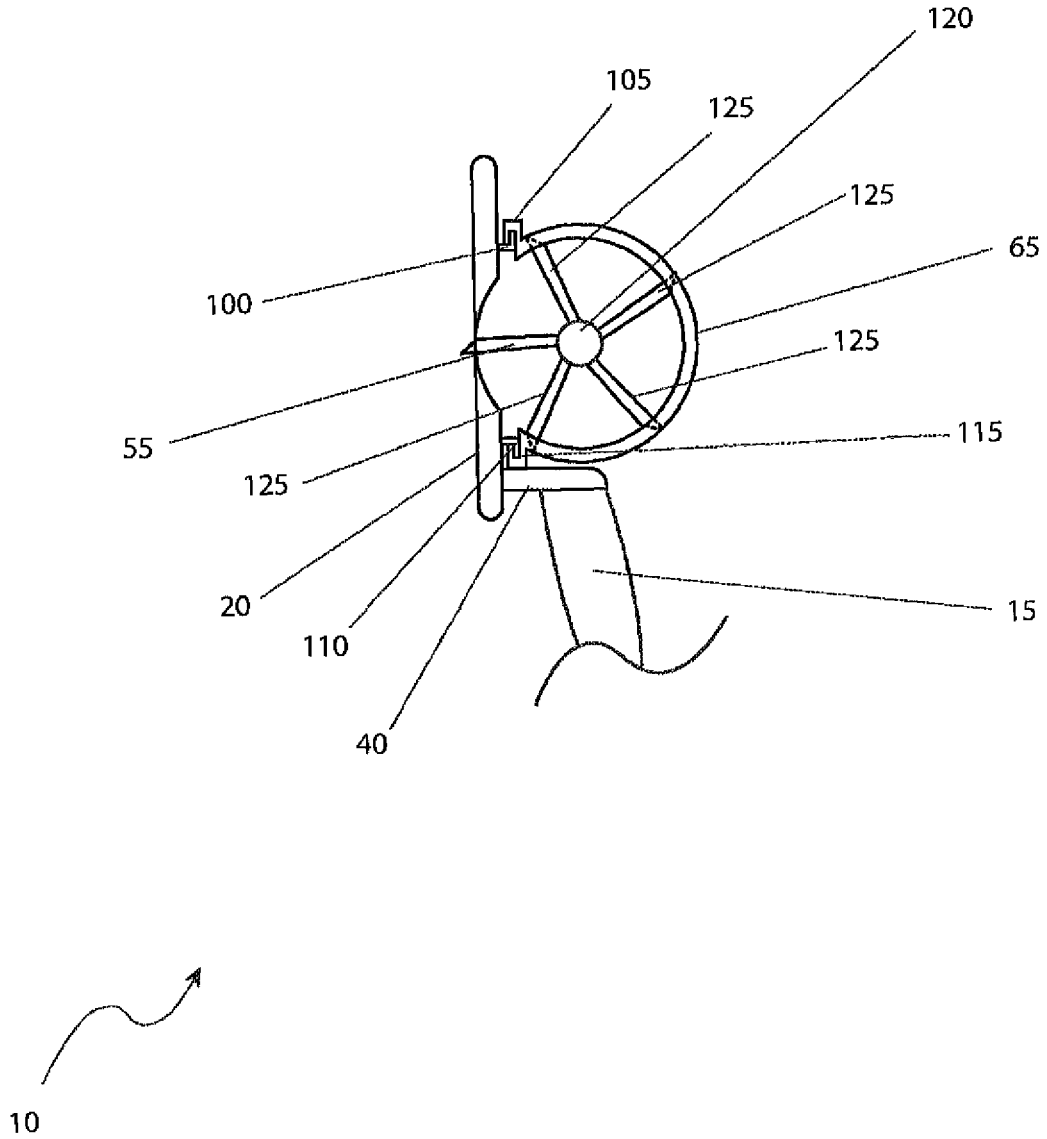
FIG. 4 is a sectional view of the shaving razor 10 with replaceable and rotatable blade cartridge 65, as seen along a line I-I, as shown in FIG. 1, according to the preferred embodiment of the present invention.
Figure 6:
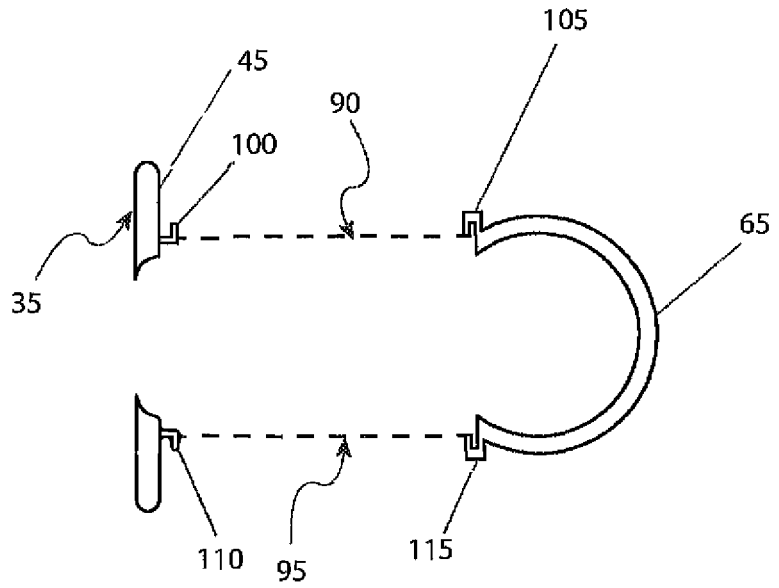

Referring next to FIG. 4 and FIG. 6, a sectional view of the device 10, as seen along a line I-I, as shown in FIG. 1, and a close-up view of the upper connection means 90 and lower connection means 95, according to the preferred embodiment of the present invention is disclosed. Only the upper flange 20 of the handle assembly 15 (as shown in FIG. 1) is depicted for purposes of clarity. The contact face 45 is attached to the upper flange 20 by the connection means 40. The upper attachment means 90 (as shown in FIG. 6) preferably comprises an upper face track 100 and an upper cartridge track 105 which are attached to the contact face 45 and the blade cartridge 65 respectively. Likewise, the lower attachment means 95 (as shown in FIG. 6) preferably comprises a lower face track 110 and a lower cartridge track 115 which are attached to the contact face 45 and the blade cartridge 65 respectively. Further description on the attachment and/or removal process of the blade cartridge 65 will be described herein below. The in-use razor blade 55 is connected to a central hub 120 within the blade cartridge 65 and is arranged with the remaining unused razor blades 125 at an angular spacing of approximately seventy-two degrees (72°). As such, the user is capable of advancing the remaining unused razor blades 125 into the position currently occupied by the in-use razor blade 55 by turning the advancement knob 75 (as shown in FIG. 3) with the aid of the protruding indicia 80 (as shown in FIG. 3) as the in-use razor blade 55 becomes dull or damaged. As replacement unused razor blades 125 are always with the device 10, the advancement can occur at any time, even within the confines of a tub or shower during the process of bathing. The interval of replacement time would vary on usage of the device 10.

Figure 5:
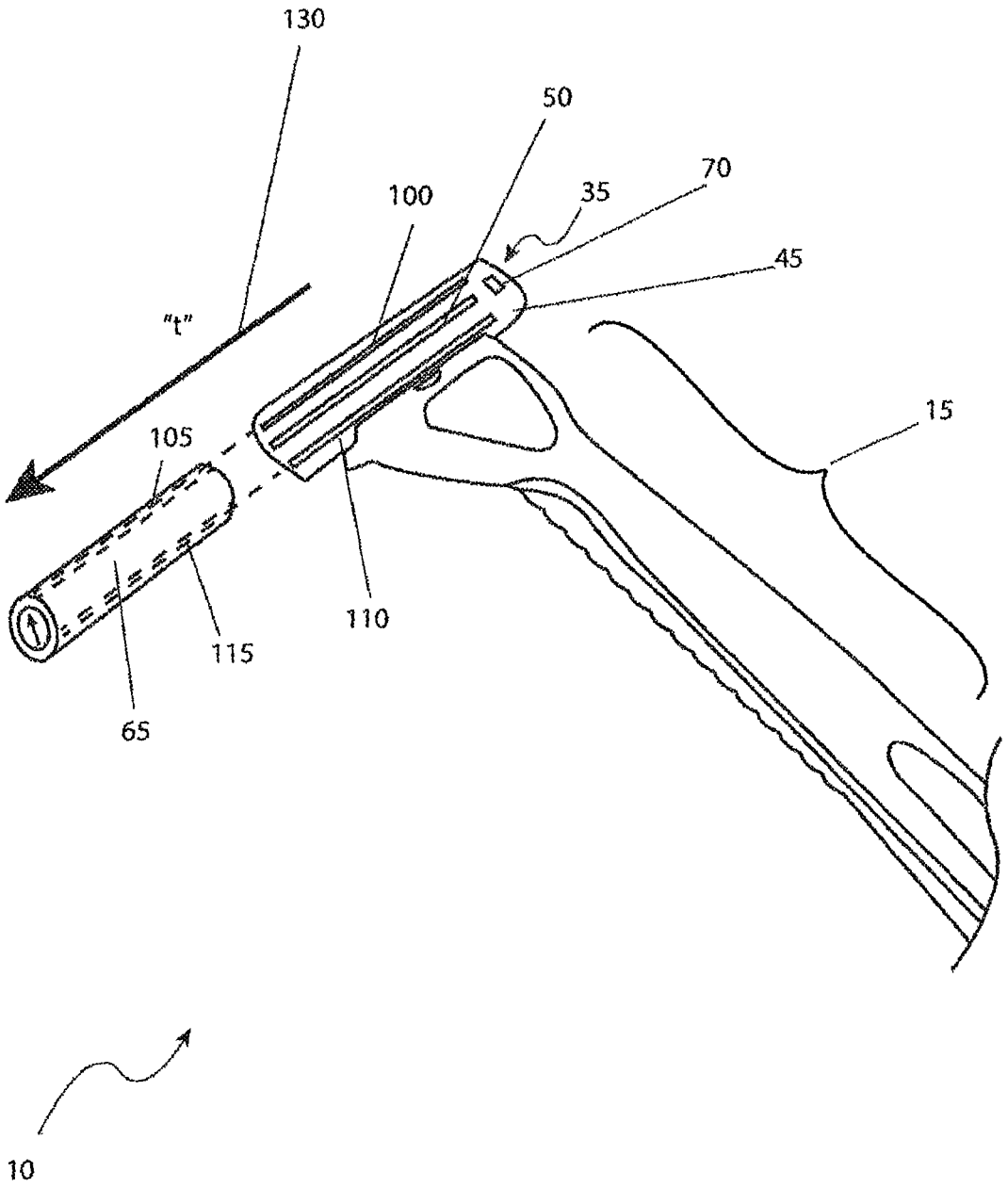
FIG. 5 is a perspective view of the shaving razor 10 with replaceable and rotatable blade cartridge 65, shown in state of the blade cartridge 65 being replaced, according to the preferred embodiment of the present invention; and, FIG. 6 is a side elevation view of the upper attachment means 90 and lower attachment means 95 for the blade cartridge 65 to the head assembly 35, according to a preferred embodiment of the present invention.

Referring to FIG. 5, a perspective view of the device 10, shown in state of the blade cartridge 65 being replaced, according to the preferred embodiment of the present invention is depicted. The blade cartridge 65 would be replaced when all five (5) razor blades 15, 125 have been utilized. To remove the blade cartridge 65, the user would hold the handle assembly 15 in a first hand while pressing on the snap retaining clip 70 with fingers from the same hand. With the other second hand, the user would then slide the blade cartridge 65 along the path of a removal travel path "t" 130. A new blade cartridge 65 would then be installed following the reverse method. The upper connection means 90 and lower connection means 95 involves the upper cartridge track 105 and the lower cartridge track 115 on the blade cartridge 65 to engage the upper face track 100 and the lower face track 110 on the contact face 45, respectively, to provide a secure fitment. The open slot 50 is visible and allows the active blade (the in-use razor blade 55 as shown in FIG. 1) to perform the shaving duties. Referring more closely now to FIG. 6, the upper cartridge track 105 and upper face track 100 are are generally "L"-shaped protrusions with a second leg parallel with the first leg to securely engage each other. The lower cartridge track 115 and lower face track 110 are identically-shaped.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels envisioned to be drug stores, discount stores, convenience stores, on-line stores and the like. Particular attention would be paid to the materials of construction with a corresponding reference to desired price point. It is assumed that the initial purchase would include the handle assembly 15 and the blade cartridge 65 already preassembled with additional blade cartridge 65 provided as part of the original purchase or as subsequent replacement components.

During utilization of the device 10, the device 10 would be utilized in the same manner as conventional shaving razors with minimal or no new learning required. The device 10 could be utilized with common shaving aids such as creams, gels or foams and with water as desired. After each use, the device 10 would be rinsed until clean.

Should the in-use razor blade 55 become worn during utilization, the user would advance the next blade into position by turning the advancement knob 75 along the path of the rotational advancement path "r" 85 approximately seventy-two degrees (72°). This action is envisioned to take no more than a few seconds. After advancement, shaving could continue as before.

Once all five (5) razor blades 15, 125 have become worn, the entire blade cartridge 65 would be replaced. The replacement would occur by the user holding the handle assembly 15 in a first hand while pressing on the snap retaining clip 70 with fingers from the same hand. With the other second hand, the user would then slide the blade cartridge 65 along the path of the removal travel path "t" 130 to disengage the upper connection means 90 and lower connection means 95 simultaneously. A new blade cartridge 65 would then be installed following the reverse method. The shaving action would then continue as before.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A shaving razor, comprising:

a handle;

a planar upper flange connected to said handle by a means for connecting, said planer upper flange having a front race, a rear face and a central horizontal open slot, said planar upper flange having an upper face track disposed superjacent said central horizontal open slot on said rear face and a lower face track disposed subjacent said central horizontal open slot on said rear face;

a blade cartridge including a plurality of razor blades, a razor blade opening, and a horizontal central hub connected to said plurality of razor blades, the blade cartridge further includes an upper blade cartridge track superjacent said razor blade opening; a lower blade cartridge track subjacent said razor blade opening, wherein said razor blade opening and said central horizontal open slot accommodate one of the plurality of razor blades in use;

the blade cartridge further includes an advancement knob located on a first end of said blade cartridge, said advancement knob advances one remaining unused razor blade of said plurality of razor blades to the position occupied by the in-use razor blade of said plurality of razor blades;

wherein said blade cartridge is arranged with said razor blades at an angular spacing of seventy-two degrees to allow advancing said remaining unused razor blades into a position occupied by said in use razor blade by turning said advancement knob with protruding indicia;

wherein said blade cartridge is removably retained in place by a sliding engagement of said upper face track with said upper blade cartridge track and a corresponding sliding engagement of said lower face track with said lower blade cartridge track; and wherein said plurality of razor blades are rotatable around an axis of the horizontal central hub.

* * * * *